United States Patent [19]

Waller

[11] 4,320,845

[45] Mar. 23, 1982

[54] COLLAPSIBLE CONTAINER

[76] Inventor: John G. Waller, 140 Old Fairburn Close Rd., Atlanta, Ga. 30303

[21] Appl. No.: 129,712

[22] Filed: Mar. 12, 1980

Related U.S. Application Data

[63] Continuation-in-part of Ser. No. 967,300, Dec. 7, 1978, abandoned.

[51] Int. Cl.[3] ..... B65D 6/18; B65D 21/02

[52] U.S. Cl. ..... 220/6; 206/509; 206/511; 220/7; 220/334; 220/337

[58] Field of Search ..... 220/6, 7, 334, 337; 206/509, 511

[56] References Cited

U.S. PATENT DOCUMENTS

| | | | |
|---|---|---|---|
| 1,620,585 | 3/1927 | Walther | 220/6 |
| 2,558,126 | 6/1951 | Davenport | 220/6 |
| 3,081,897 | 3/1963 | Livingston | 206/511 |
| 3,186,585 | 6/1965 | Denny | 206/511 |
| 3,254,786 | 6/1966 | Melville | 220/6 |
| 3,446,415 | 5/1969 | Bromley | 220/7 |
| 3,463,345 | 8/1969 | Bockenstette | 220/337 |
| 4,181,236 | 1/1980 | Prodel | 220/6 |

FOREIGN PATENT DOCUMENTS

| | | | |
|---|---|---|---|
| 234301 | 11/1963 | Austria | 220/337 |
| 1494178 | 7/1967 | France | 220/6 |
| 6709795 | 1/1969 | Netherlands | 220/6 |

*Primary Examiner*—George E. Lowrance
*Attorney, Agent, or Firm*—Newton, Hopkins & Ormsby

[57] ABSTRACT

A collapsible container formed of flexible plastic has complimentary parallel side wall members hingedly connected at their ends by complimentary end walls members and hingedly carrying complimentary bottom panels which fold down to rest upon ledges on the side wall members and end wall members. Diagonally opposed corner portions of the side wall members space the hinge axes of the end wall members away from the side wall members so that, when collapsed, an end wall member and a side wall member are coplanar and in spaced parallel adjacent relationship to the other end wall member and side wall member to sandwich the foled up bottom panels, therebetween.

The length of each side wall member is generally twice the effective length of an end wall member to provide a container which is modular for locking together with other such containers, when stacked in alignment or cross-tied. Most of the hinge pins are integrally formed with the wall members and panels to snap into place. Openings in the side wall members permit pricing of articles and opening in the bottom panels permit the use of vertically movable loading rods for automatically stacking articles in the container.

In a second embodiment inclined alignment lugs draw in the wall members in when one container is stacked on the next.

26 Claims, 20 Drawing Figures

COLLAPSIBLE CONTAINER

CROSS REFERENCE TO RELATED APPLICATION

This is a continuation-in-part of my copending application Ser. No. 967,300 filed Dec. 7, 1978 now abandoned.

BACKGROUND OF THE INVENTION

1. Field of the Invention

This invention relates to collapsible containers and is more particularly concerned with a collapsible container which can be righted to form an open top receptacle or folded to a flat condition when not in use.

2. Description of the Prior Art

In the past, collapsible containers of various kinds have been produced. For example, paper board cartons, which are shipped in a collapsed or flattened condition, are used extensively, the carton being righted by squaring the side walls and folding in and sealing the top and bottom flaps.

Metal and plastic collapsible containers have also been devised. One plastic container, known as the "Perry" container, has walls which are hinged to a flat rigid bottom, the walls folding upwardly to vertical positions. The ends of such walls are latched together. The "Perry" container is expensive, requires considerable time to assemble and disassemble, and does not lend itself to machine righting or to cross-tying on a pallet. U.S. Pat. No. 3,516,592 illustrates one type of collapsible container with fold up sides.

When eggs are shipped in conventional corrugated cases, the cartons of eggs must fit snuggly therein or else the case will bow out. However, tight fitting cartons cause egg breakage. With conventional wire cases, these cases must taper for nesting one within the next. This means that the egg cartons at the bottom must fit tightly and those at the top, loosely. The truck width prevents the widening of such prior art wire cases to receive both the large egg carton and the jumbo carton.

SUMMARY OF THE INVENTION

Briefly described, the present invention includes a collapsible container which has complimentary parts, requiring only three dies for forming two identical side wall members, two identical end wall members and two identical bottom panels.

The collapsible container will cross-tie and stack, being made of a flexible plastic, preferrably pure polyethylene, thereby permitting the hinged portions and the sides to flex. Sufficient flexibility and thinness are imparted to the container that it is light and strong and will bow; however, nesting of the containers pulls the sides of lower containers in and holds them. The regular, i.e., large size egg cartons, fit sufficiently loosely into the container that they are easy to remove and there is less egg breakage. Nevertheless, the present container will receive and hold both the regular egg carton and the jumbo egg carton.

In the container of the present invention, the complimentary parallel side wall members are hingedly connected at their ends by complimentary end wall members and hingedly carry complimentary bottom panels which fold down to interlock with and rest upon ledges on the end wall members and side wall members. Diagonally opposed corner portions of the side wall members space the hinge axes of the end wall members away from the side wall members so that, when collapsed, an end wall member and a side wall member are coplanar and in spaced parallel relationship to the other end wall and side wall to sandwich the folded up bottom panels, therebetween.

The length of the side wall members is generally twice the effective length of an end wall member to provide containers which are modular for locking together when stacked in alignment or cross-tied. Most of the hinge pins are integrally formed with the wall members to snap into place. Openings in the side walls permit pricing of articles and openings in the bottom panels permit the use of vertically moveable loading rods for automatically stacking articles in the container.

Accordingly, it is an object of the present invention to provide a collapsible container which is inexpensive to manufacture, durable in structure, and efficient in operation.

Another object of the present invention is to provide a collapsible container which is made up of a small number of parts and which can be readily and easily assembled and diassembled.

Another object of the present invention is to provide a collapsible container which is particularly suitable for containing stacked egg cartons and other articles of food and which permit the pricing of the cartons or other articles through the sides of the container.

Another object of the present invention is to provide a collapsible container which is capable of use with an automatic stacking machine for automatically stacking cartons of eggs into the container.

Another object of the present invention is to provide a collapsible container which, when collapsed, can be readily and easily stored in a small area and which will nest with like containers in a collapsed condition.

Another object of the present invention is to provide a collapsible container which can readily and easily be righted either by hand or by machinery and which when righted forms a rugged container.

Another object of the present invention is to provide a container of the type having hinged bottom panels and in which the weight of the articles is carried by the side walls, rather than hinged portions.

Another object of the present invention is to provide a collapsible container which, when righted will readily and easily nest with other similar containers, one on top of the other, and which will also readily and easily cross-tie with other similar containers.

Another object of the present invention is to provide a collapsible container which is sufficiently rigid that it may be stacked and sufficiently flexible and so constructed that the sides will flex and be drawn in when nested or cross-tied.

Another object of the present invention is to provide a container which is capable of receiving both regular size egg cartons and jumbo size egg cartons.

Another object of the present invention is to provide a collapsible container which is particularly suited for being received in a stacked and cross-tied condition on a standard pallet.

Other objects features and advantages of the present invention will become apparent from the following description when taken in conjunction with the accompanying drawings wherein like characters of reference designate corresponding parts throughout the several views.

DESCRIPTION OF THE PREFERRED EMBODIMENTS

Figure 1:
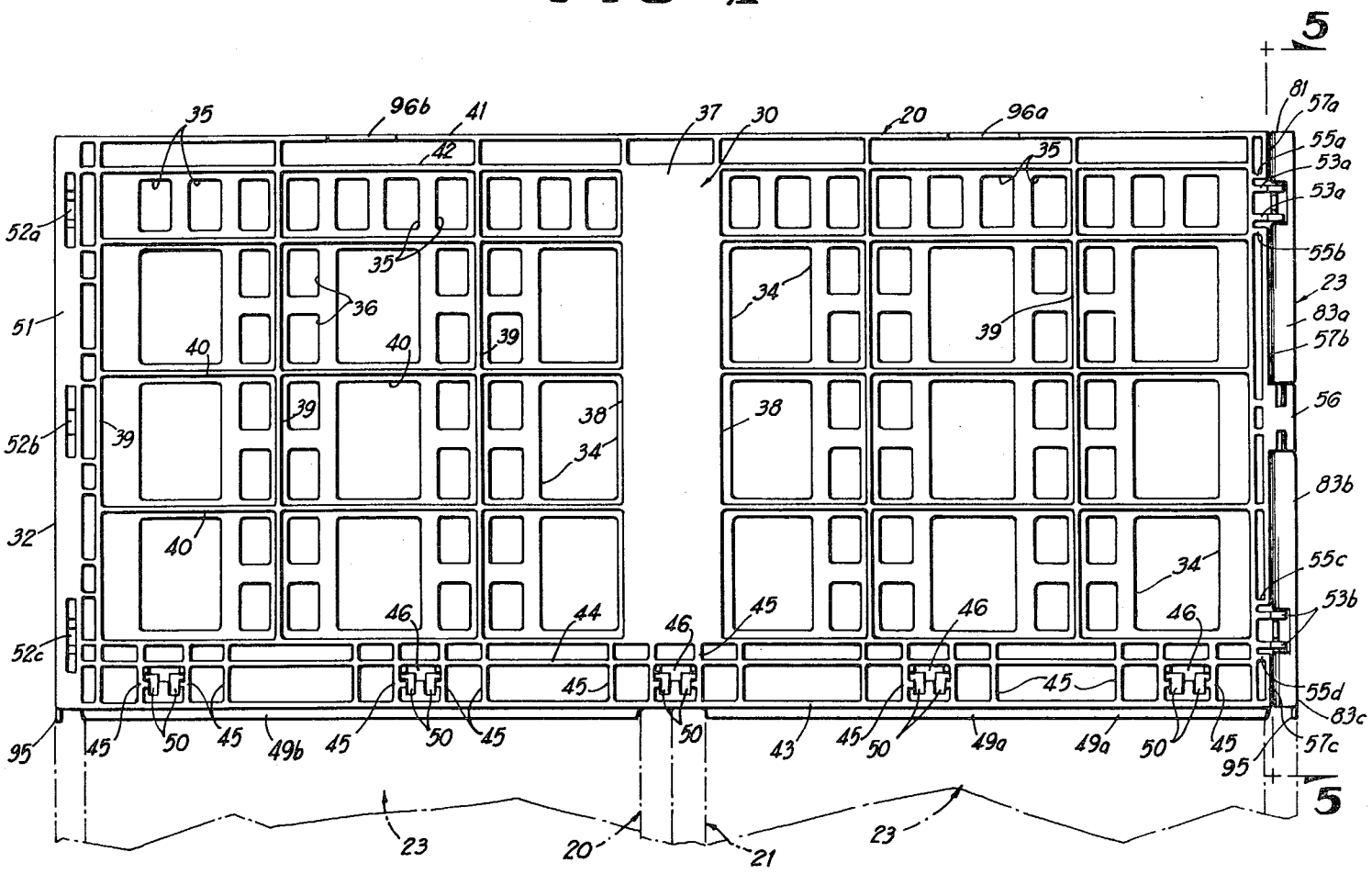
FIG. 1 is a side elevational view of a collapsible container constructed in accordance with the present invention the container being in a righted condition and the cross-tying with other similar containers being illustrated in broken lines.

Referring now to the embodiments chosen for the purpose of illustrating the present invention, numeral 20 denotes generally the side wall member of the container of the present invention. This side wall member 20 is identical to and parallel to side wall member 21 and, hence, the detailed description of the same will be confined to the side wall member 20, it being understood that the side wall members 20 and 21 are injection molded and come from the same injection mold.

The container of the present invention also includes end wall members 23 and 24 which are hingedly secured, as will be explained hereinafter, to the ends or end portions of the parallel side wall members 20 and 21. The end wall members 23 and 24 are also parallel to each other, are made of plastic, are injection molded and come from the same mold.

Hingedly secured to the bottom portion of the side wall members 20 and 21, respectively, are the opposed bottom panels, denoted generally by numerals 25 and 26. These bottom panels 25 and 26 are also identical and are formed of plastic, being injection molded and coming from the same mold.

Thus, it is seen that the major components of the collapsible container are made from three molds. The retainer hinge pins 27 and 28, together with these previously described panels and wall members are all that is necessary to produce the collapsible container of the present invention.

Preferrably these major components are formed of polyethylene so that the components will flex but be sufficiently rigid that they may be stacked and cross-tied.

Referring now to the side wall member, such as side wall member 20, it will be seen that this side wall member is an L-shaped which includes a side wall 30 and a corner portion or hinge member 31 joined together along a common edge or corner 32, the end member 31 being perpendicular to the side wall 30. The wall 30 is rectangular in shape, and includes a relatively large, rectangular, inner, flat thin panel 33 having a plurality of large rectangular openings 34 which are arranged in equally spaced relationship in horizontal and vertical rows. If the container of the present invention is to be used to contain cartons of eggs, these large openings 34 provide sufficient space for the making of an appropriate price on the end of each carton. Thus, as illustrated in FIG. 1, there are six openings 34 in a first or lowest row, there are six additional openings 34 in a second or middle row, and there are six still further openings 34 in the top row.

Above the top row are a plurality of evenly spaced smaller openings 35 arranged in a horizontal or longitudinal row. The material on the interior of the container also may be marked through these smaller openings 35. Furthermore, between the adjacent large openings 34 in each horizontal row, there are small openings 36, namely four openings, two to a row. Such small openings 35 and 36 do not exist along a central portion of wall 30 which is provided a vertically extending rectangular, central panel 37 which is offset, from the plane of the larger inner panel 33, by the spaced vertical control reinforcing ribs 38.

Additional vertical reinforcing ribs 39 which are evenly spaced from each other on both side of the ribs 38 provide reinforcement for the wall 30. The vertical ribs 39 are criss-crossed by a plurality of vertically spaced, parallel, reinforcing horizontal ribs 40, the inner edges of the ribs 38, 39 and 40 being integrally joined to the panel 33. The inner ends of the horizontal ribs 40 are joined to the ribs 38 and the outer ends of the ribs 40 are joined to the outer most of the ribs 39. The ribs 39 and 40 thus form rectangular frames which encompass a large opening 34 and some of the small opening 36. The ribs 39, which are inwardly of the outermost ribs 39, pass between adjacent pair of small openings 36, as seen in FIG. 1.

Ribs 39 extend above the uppermost rib 40, passing between adjacent openings 35 to terminate at the upper flange 41 which protrudes forwardly from the upper edge of inner panel 33. Between the uppermost horizontal rib 40 and the upper flange 41 is an additional longitudinal or horizontal rib 42 which extends throughout the length of the panel 33. The rib 42 is above the smaller openings 35 but spaced below the upper flange 41. The upper flange 41 and the ribs 39, 40 and 42 are of identical width or thickness, the thickness being seen for upper flange 41 in FIG. 2. The panel 33, between the flange 41 and the rib 42, is solid.

At the lowermost portion of the wall 30 there is a lower longitudinally or horizontally extending flange 43 which is parallel to the horizontal ribs 40 and 42 and also parallel to the upper flange 41. Between the lowermost horizontal rib 40 and the flange 43 is an additional reinforcing rib 44. There are also additional short vertical reinforcing ribs 45 which extend from the flange 43 to the lowermost horizontal rib 40. Between certain of the adjacent ribs 45 there are provided hinge arm openings 46, the function of which is to receive the opposed pairs of hinge arms 50 which pertrude from the bottom panel 25, or 26, as the case may be. As shown in FIG. 1, there are five equally spaced hinge arm openings 46 arranged in a horizontal row along the bottom portion of the panel 33.

All the ribs and flanges extend outwardly in the same direction to form a reinforcing lattice for panel 33. Flange 43 is wider than flange 41 and protrudes inwardly of inner panel 33, being provided with a pair of vertical nesting flanges 49*a* and 49*b*, separated by a central opening 48, between the adjacent ends of the vertical flanges 49*a* and 49*b*. The flange 49*a* extends to the right to the ends of the wall member 30; however, the flange 49*b* terminates in inwardly spaced relationship to the common edge 32 on the left.

Spaced parallel to and outwardly of the left outermost vertical rib 30 of wall 30 is the corner post 51, one edge of which is the corner edge 32. The corner post 51 is provided with three vertically, equally spaced, rectangular, alignment slots 52*a*, 52*b* and 52*c*.

At the other or right hand end of wall 30 are the upper, lower and central hinges. In more detail, the upper hinge includes a pair of outwardly protruding spaced parallel, hinge arms 53*a*, provided at their outer end portions with vertically aligned, opposite outwardly protruding cylindrical pins 54*a*. The lower hinge is substantially identical to the upper hinge and includes outwardly protruding hinge arms 53*b* provided with oppositely, outwardly protruding, cylindrical hinge pins 54*b*, aligned along a vertical axis with the hinge pins 54*a*. This vertical axis is outwardly adjacent and parallel to the aligned side flanges 57*a*, 57*b*, 57*c* which flanges extends parallel to and outwardly adjacent the outermost rib 39. Upper side flange 57*a* extends from the outer end of upper flange 41 to terminate at a connector bar 55*a* which is spaced from but parallel and adjacent the upper arm 53*a*. Connector bars 55*b* are similarly spaced respectively from arms 53*a* and 53*b*, the bars being connected to the ends of the central side flange 54*b*. Connector bar 55*c* is also provided for the inner end of lower side flange 54*c* which extends up from lower flange 43.

Protruding outwardly from the central portion of central side flange 57*b* is a journal block 56 having a vertical pin journalling holes therein, the axis of which is in vertical alignment with the axis of the pins 54*a* and 54*b*.

Figure 2:
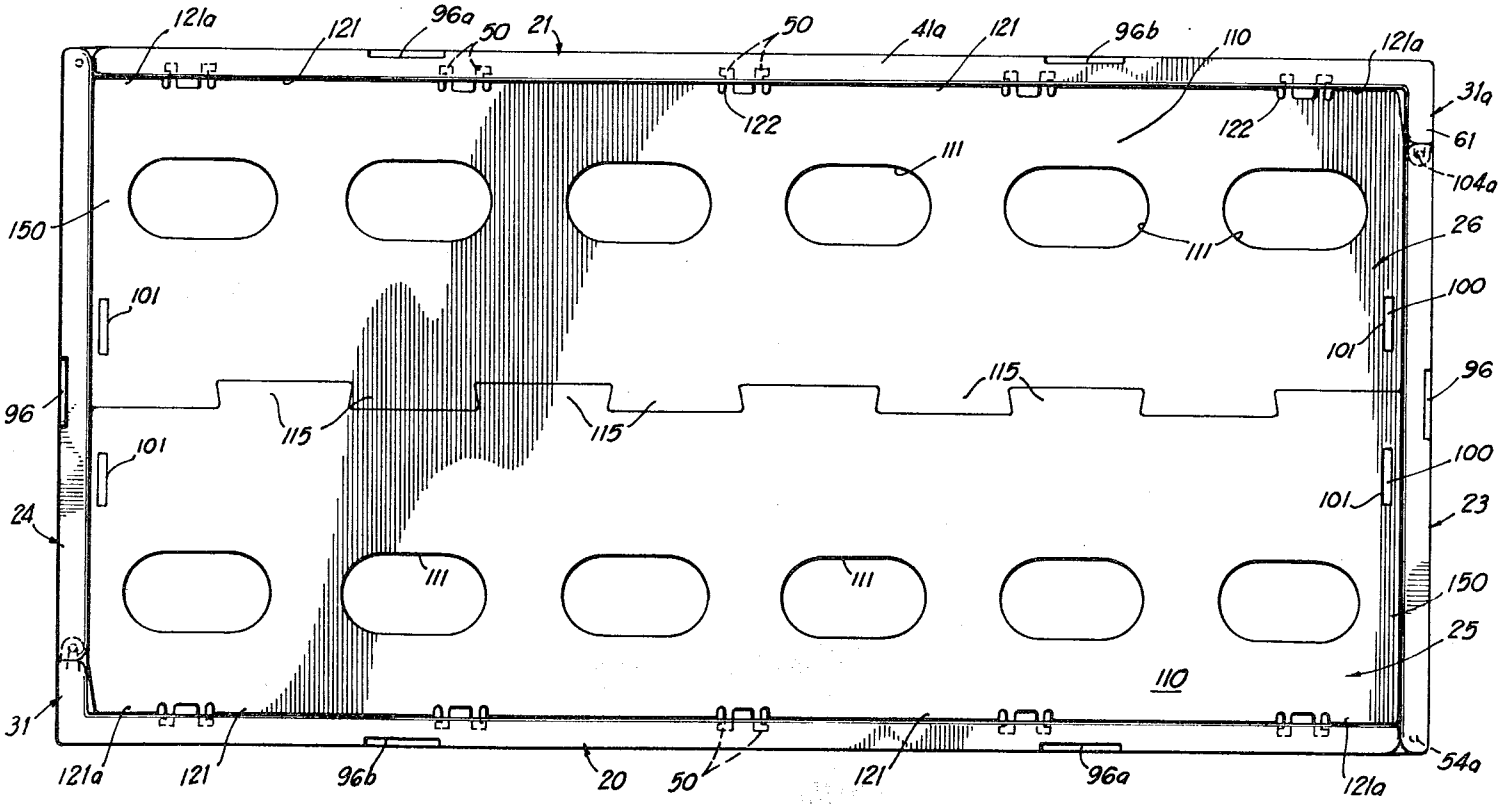
FIG. 2 is top plan view of the container depicted in FIG. 1.
Figure 3:
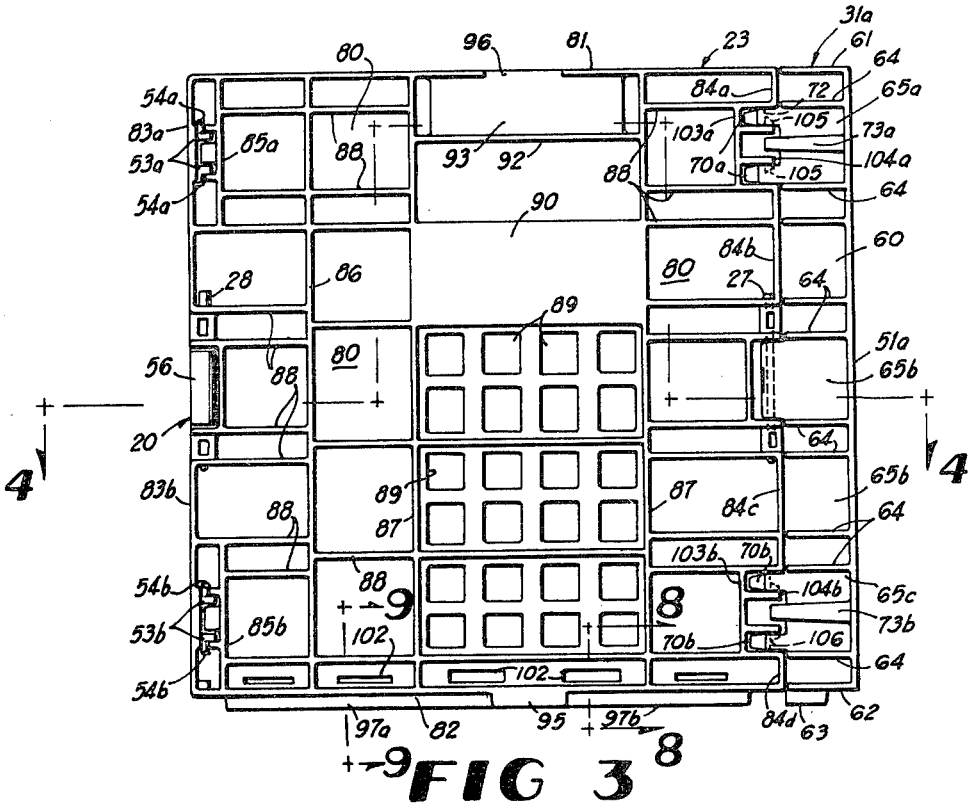
FIG. 3 is a end elevational view of the container depicted in FIG. 1 and FIG. 2.

As best seen in FIG. 3, the side wall member (which is identical to side wall member 20) includes a hinge member 31*a*, identical to hinge member 31 and the same corner post 51*a* which is identical to post 51 of member 20. The hinge member 31*a* includes an inner thin flat rectangular panel 60 which extends from an upper outwardly protruding top flange 61 to an outwardly protruding lower flange 62 at its lower edge. The end of flange 61 is joined at a right angle to the end of a top or upper flange 41*a* of wall member 21, as shown in FIG. 2. The lower flange 62 is similarly joined to the lower flange of member 21 which corresponds to lower flange 43 of member 20. Also, flange 62 is wider than flange 61 and protrudes inwardly of panel 60 and is provided with a vertical nesting flange 63 protruding downwardly from its inner edge. The end of flange 63 is joined to the end of flange 49*a*.

A plurality of vertically spaced, horizontally extending, reinforcing ribs 64 protrude outwardly from the outer surface of panel 60, the outer ends of such ribs 64 being connected to post 51*a*. Between the upper two ribs 64 is an upper hinge plate 65*a* and between the lower two ribs 64 is a lower hinge plate 65*c*. There is also a central hinge plate 65*b* between the central ribs 64. These hinge plates are in a plane outwardly of the plane of panel 60, the ends of the upper and lower plates 65*a* and 65*c* being bifurcated to provide pairs of forwardly protruding vertically spaced alignment fingers 70*a* and 70*b*. The central plate 65*b* protrudes outwardly of the edge of the panel 60 and then loops around to be integrally joined with the edge of panel 60 and thereby provide a hinge pin journalling cradle 71 which receives the central portion of hinge pin 27. The fingers 70*a* and 70*b* are provided, adjacent their base, with opposed pairs of pivot pin receiving holes 72. The axes of which are in alignment vertically with the axis of pin 27.

Along the central outer portion of the plates 65*a* and 65*c* are respectively the innerlock fingers 73*a* and 73*b* which protrude to positions adjacent and outwardly of the holes or openings 72.

On the inner side of the wall members 20 and 21 there is a bottom panel supporting ledge 74 which is formed by the lower flanges such as flange 43 and flange 62.

Figure 4:
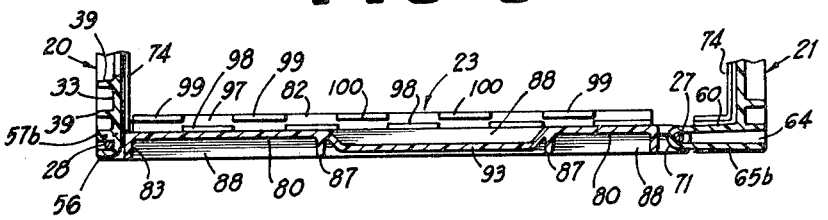
FIG. 4 is a fragmentary horizontal sectional view taken substantially along line 4—4 in FIG. 3, the bottom panels being removed for clarity.
Figure 5:
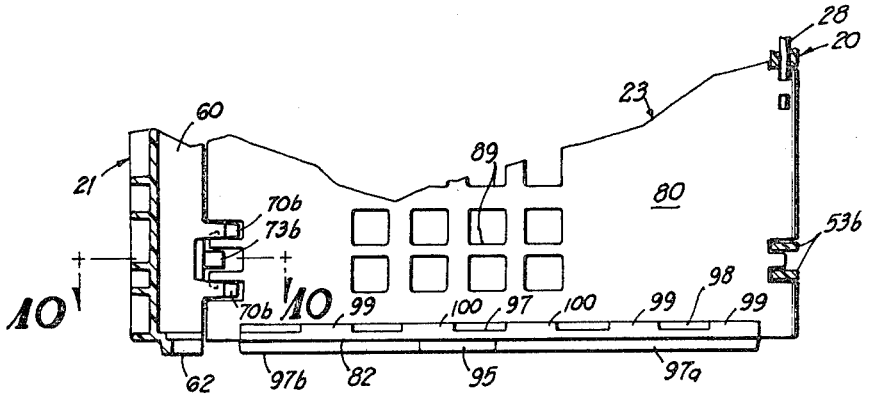
FIG. 5 is a fragmentary cross-sectional view taken substantially along line 5—5 in FIG. 1.

Referring now primarily to FIGS. 3 and 4, the end wall members 23 and 24 each includes, as seen in FIGS. 3 and 4, an inner think flat, rectangular panel 80 which is reinforced along its perimeter by an upper outwardly protruding flange 81, a lower outwardly protruding flange 82, side flanges 83*a* and 83*b* which are in vertical alignment along one side edge and said flanges 84*a*, 84*b*, 84*c* and 84*d* which are in vertical alignment along the other side edge thereof. Inwardly of the side flanges 83*a* and 83*b* are a pair of vertically aligned reinforcing ribs 85*a* and 85*b*. Other reinforcing ribs include the vertical rib 86 and central vertical ribs 87, in addition to a plurality of horizontal reinforcing ribs 88 which intersect the vertical ribs 86 and 87. All of these ribs extend outwardly from the panel 80 and terminate in a common plane parallel to the panel 80.

Between the vertical ribs 87 in the lower and central portion of the panel 80 there are a plurality of small square openings 89 which lighten the panel 80 and also provide access openings for viewing the interior of the container. These square openings 89 are arranged in horizontal and vertical rows. Certain of the ribs 88 pass between adjacent horizontal rows. Above the uppermost row of openings 89 is an outer panel 90 which is formed in a plane forwardly of the plane of panel 80, the panel 90 functioning as a main plate panel and being integrally joined to the outer edge portion of the central vertical ribs 87. Also, the upper and lower edges of the panel 90 are joined to adjacent horizontal ribs 88. Above the panel 90 is an opening large enough for a person to insert his hand therethrough. This opening is defined by the ribs 87 and 88 and an intermediate central rib 92.

Above the opening 91 and between the central rib 92 and the upper flange 81 is a hand plate 93 the major portion of which includes a flat plate substantially parallel to the plate 90; however, the ends of the plate curve inwardly to abutt and merge with the inner edges of the vertical ribs 87. This provides an inwardly opening carrying recess closed on the outer side but of sufficient depth to receive the fingers of a person.

The outer central portion of the lower or bottom flange 82 is provided with a downwardly protruding central lug 95, the function of which is to be received in a cutout portion or recess 96 in the central portion of the upper end flange 81 of a next adjacent container when the containers are nested with their sides aligned. The lug 95 will be selectively received in cut out portions 96*a* and 96*b* in the upper side flange 41. The lug 95 is parallel to and spaced forwardly of a downwardly protruding nesting flange 97 disposed along the inner edge portion of the lower flange 82. When the container is righted, the flange 97 is aligned with the flange 63 of the wall member 21.

Along the upper surface of bottom flange 82 and inwardly of the panel 80 the flange 82 forms a panel receiving ledge having a flat upper surface 97 provided, adjacent the panel 80, with an inclined camming surface 98. Spaced upstanding lugs 99 along the inner edge of the flange 82 are for the purpose of aligning the panels 25 and 26. The two central upstanding lugs 100 are for projecting through the openings 101 in the panels 25 and 26.

Along the lower portion of panel 80 there are a plurality of elongated slots 102 arranged in a horizontal row so that the position of the panels 25 and 26 may be observed through these openings.

Inwardly of the plane of the plane of the side flanges 84*a*, 84*b*, 84*c* and 84*d* are the pivot arm supporting flanges 103*a* and 103*b*. A pair of upper pivot arms 104*a* extend laterally away from the flange 103*a* in spaced parallel relationship to each other and in spaced parallel relationship to the adjacent horizontal ribs 88. In like fashion, the panel 103*b* is provided with pivot arms 104*b*. Short pivot pins 105 project upwardly and downwardly, i.e., in opposite directions from the pivot arms 104*a* and additional pivot pins 106 project from the pivot arms 104*b*. These pivot pins 105 and 106 are respectively received in the hole 72. The pivot pins 105 and 106 are thus disposed along the axis of pivot pin 27 and this axis is adjacent or in generally the plane of the inner panel 80. The function of the fingers 73*a* and 73*b* is to project between the adjacent arms 104*a* and the adjacent arms 104*b* when the container is righted so as to preclude the inadvertent flexing of the arms 104*a* and 104*b* sufficiently to remove the pins 105 and 106 from their sockets formed by the hole 72. When the container is a flattened condition the fingers 70*a* and 70b protrude beyond the outer surface of the end wall member so as to protrude into the openings 52*a*, 52*b*, 52*c* (FIG. 1) of a next adjacent collapsed container. This provides for the nesting of the containers in their flattened condition so that they may be readily transported on pallets.

As best seen in FIG. 2, the panels 25 and 26 which are identical to each other, include generally flat inner plates 110 provided with a longitudinal row along the center portion of each plate of openings 111. The purpose of these openings 111 is to receive the upstanding rods when the carton is used with my container loading machine as depicted in my U.S. Pat. No. 4,104,846, issued Aug. 8, 1978. Thus, the egg cartons can be readily stacked into the righted container as depicted in my above mentioned patent.

Each plate 110 is generally rectangular in shape having a serrated outer edge which provides a plurality of spaced dovetail lugs 115 which are received in recesses between the lugs 115 of the adjacent plate 110. Thus, when the bottom panels 25 and 26 are disposed in coplanar relationship, as illustrated in FIG. 2, the container thus being in a righted condition, the lugs 115 of one panel 26 are received between a pair of lugs 115 of the other panel 25 so as to lock the two panels together. Furthermore, the upstanding lugs 100 will protrude through the openings 101.

Figure 7:
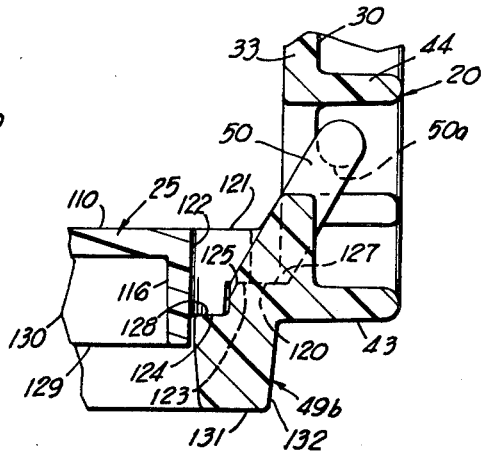
FIG. 7 is a cross-sectional view taken substantially along line 7—7 in FIG. 6.
Figure 8:
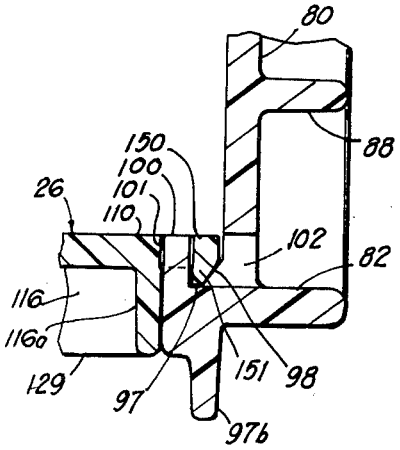
FIG. 8 is an enlarged cross-sectional view taken substantially along line 8—8 in FIG. 3.
Figure 9:
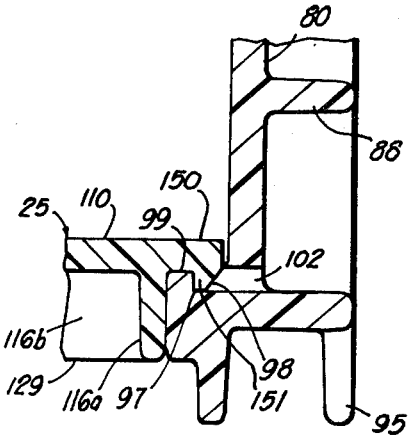
FIG. 9 is an enlarged cross-sectional view taken substantially along line 9—9 in FIG. 3.
Figure 10:
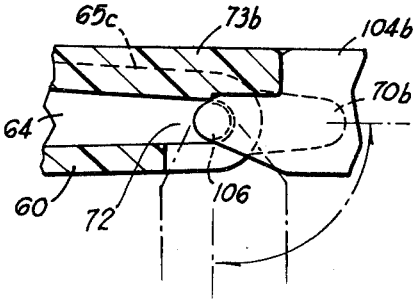
FIG. 10 is an enlarged cross-sectional view taken substantially along line 10—10 in FIG. 5.

Each plate 110 includes a downwardly extending continuous perimeter flange, including a side flange 116, shown in FIGS. 7 and 8, and end flanges 116*a* seen in FIGS. 8 and 9. The perimeter flange also includes and an edge flange 116*b* depend from the outer serrated edge of the panel 110 and which follows the contour of the serrated edge of panel 110. Each flange 116 is tapered, the lug portion being tapered, downwardly and the recess portions tapered, upwardly to cam the plates 110 into coplanar relationship.

Figure 6:
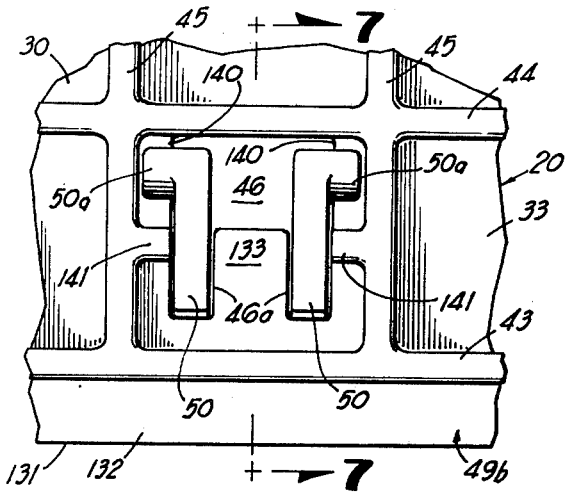
FIG. 6 is an enlarged cross-sectional view taken substantially along line 6—6 in FIG. 2.

The outer portion of flange 116, adjacent the wall member 20 or 21, as the case may be, is perpendicular to its associated plate 110, as seen in FIG. 7. Pairs of equally spaced pivot arms 50 are integrally joined by their inner ends to the flange 116 and project outwardly and upwardly therefrom to terminate in rounded outer ends, respectively provided with longitudinally extending opposed aligned pivot pins 50*a* and 50b. The bottom portion of the arms 50 are flat, as at numeral 120, so that when the panel plate 110 is in its horizontal, load carrying position, as depicted in FIGS. 6 and 7, the pivot pins 50*a*, 50*b* are in their raised positions.

Between adjacent pairs of arms 50 are step like outwardly protruding panel supporting, shoulders 121 which are secured to the outer surfaces of the flange 116. Similar shoulders 121*a*, as shown in FIG. 2, extend from adjacent the outer arms 50 to the corners of the panels 25 and 26. The ends of shoulders 121 and 121*a*, which are adjacent to the hinge arms 50, are spaced therefrom, as seen in FIG. 2. Rounded concaved portions 122 on flange 116 merge the inner ends of the shoulders 121, 121*a* to their adjacent inner ends of the arms 50.

As best seen in FIG. 7, while the upper surfaces of shoulders 121, are coplanar with the upper surface of their panel 110, the lower surface of each shoulder 121 (and 121*a* for that matter) has stepped surface 123 in a common plane with bottom portion 120 and a lower surface 124 stepped or offset and in a plane below surface 123, the outer edge of surface 124 being joined to the inner edge of surface 123 by a vertical surface 125.

When the container is righted, the bottom portion 120 of arms 50 and the outer surface 123 rest upon that portion of the upper surface flange 43, which forms an upper ledge 127 extending inwardly from the inner panel 33 of side wall 30. Furthermore, the inner surface 124, which is lower than surface 123, rests upon a stepped and lower ledge 128 on the inner upper surface of the vertical flange 49*a* or 49*b*, as the case may be.

In such a righted condition, the container has an open top to receive the articles, such as egg cartons. The bottom surfaces 129 of the bottom panels 25 and 26, i.e. the bottom of the reinforcing ribs 130 and bottom of the flange 116 are spaced above the lower edge 131 of vertical flange 49*a* or 49*b* while the slightly inwardly and downwardly tapering outer surface 132 of flange 49*a* or 49*b* is inwardly of the plane of the inner vertical surface of inner panel 33. Thus, one open container can nest on the next, with the lower surface of flange 43 of one container being received on the upper surface of the upper flange 41 or 41*a* of the next.

It will be observed in FIG. 6 that the opening 46, through which the arms 50, protrude is defined by opposed parallel vertical sides edges 140 which are slightly wider apart than the distance between the outer surfaces of the pair of legs 50 which it receives, but less wide than the distance between the ends of pins 50*a*. Thus, the arms 50 must be flexed inwardly, when being initially inserted into opening 46, and will then spring to their original parallel relationship with the pins 50*a* on the outer side of panel 33 and arresting withdrawal of the arms 50 through opening 46.

The arms 50, themselves, are received in spaced parallel upwardly opening slot 46*a* at the bottom portion 46, when the bottom panel 25 or 26 is horizontal, as when the container is righted. In such a position substantially all of the weight of the panel 25 or 26 is carried by the ledges 127 and 128 and by the end ledges 97*a* and 97*b*. The pins 50*a* are spaced slightly away from the outer surface of panel 33 so that arms 50 are not normally flexed by any weight placed on the panels 25 or 26.

As seen in FIG. 6, the slots 46*a* define, therebetween an upstanding finger 133 which is part of the inner panel 33. Finger 133 form a stop which precludes inwardly flexing, to any appreciable extent, of the arms 50, when the container is righted.

When the container is collapsed or folded, the panels 25 and 26 fold upwardly in an arcuate path generally about the transversely parallel aligned axes of the pins 50*a* which are adjacent a given panel 33. The pins 50*a* pivot in outwardly opening sockets defined by the panel 33, a rib 44 and a pair of spaced opposed horizontal aligned outwardly extending shoulders 141 which are midway between flange 43 and a rib 44. The outer ends of shoulders 141 merge with sides of adjacent vertical ribs 45. Thus, these sockets form a loose journal for pins 50*a*. The length of arms 50 permit the panel 25 or 26 to fold flat against its associated wall 30.

In FIG. 8 and FIG. 9 it is seen that, when the panel 26 is horizontal, the container being in the righted condition, one of the upstanding lugs 100 projects through holes in the horizontal end flanges 150 as the bottom of the end flange 150 rests upon the upper edge of upstanding lug 99. Also, the outer surface of end flange 116*a* abuts the inner end of lower flange 82 while a downwardly extending lip 151 on the end of flange 150 protrudes into the space between the lugs 99 and 100 and the inner surface of panel 80. Lip 151 has a bevelled lower outer edge which cooperates with the camming surfaces 98 in assuring the proper seating of panel 26.

OPERATIONS

Figure 11:
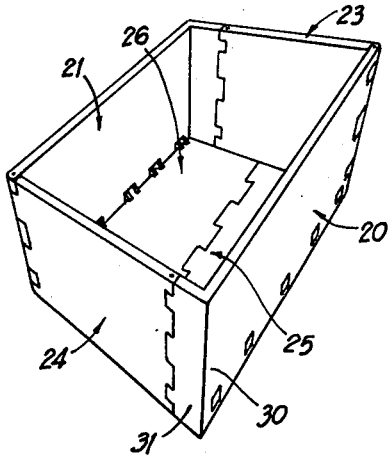
FIG. 11 is a schematic perspective view of the collapsible container depicted in FIG. 1 in a righted condition.

From the foregoing description, the operation of the present container should be apparent. As shown in FIG. 11, the container, when in its righted condition, has the side wall members 20 and 21 in space opposed, parallel relationship, and the end wall members 23 and 24 are likewise in spaced opposed parallel relationship but perpendicular to the main side wall 30 and parallel to their respective end portions 31. Also, the bottom panels 25 and 26 are disposed in interlocking relationship, parallel to each other and perpendicular to the side wall members 20, 21, 23 and 24. In such a position, the container is available to receive articles deposited therein. Indeed, the loading rods (not shown), as mentioned hereinbefore, can be inserted up through the bottom holes 111 to receive the layers of egg cartons and to progressively stack such layers in place in the container. This is covered by my previous U.S. Pat. No. 4,104,846.

Figure 12:
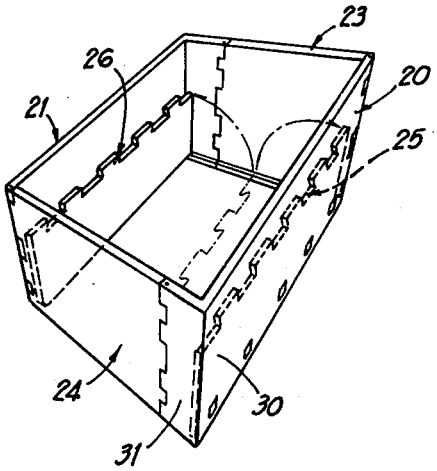
FIG. 12 is a view similar to FIG. 8 but showing the container with the bottom panels folded up, preparatory to collapsing the container.
Figure 13:
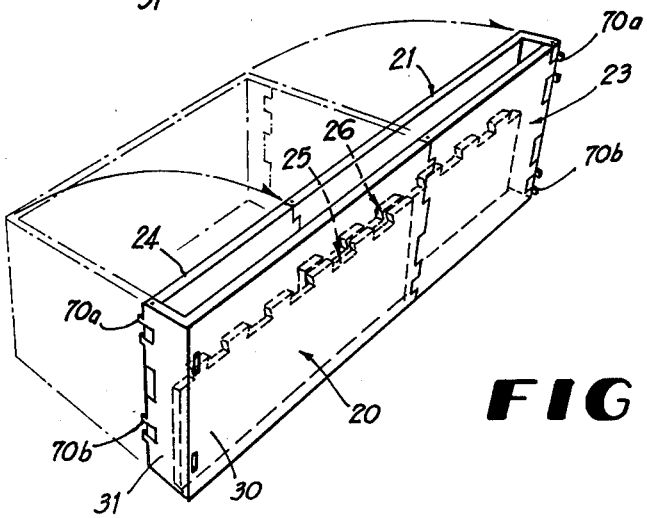
FIG. 13 is a schematic perspective view of the container in a collapsed condition.
Figure 14:
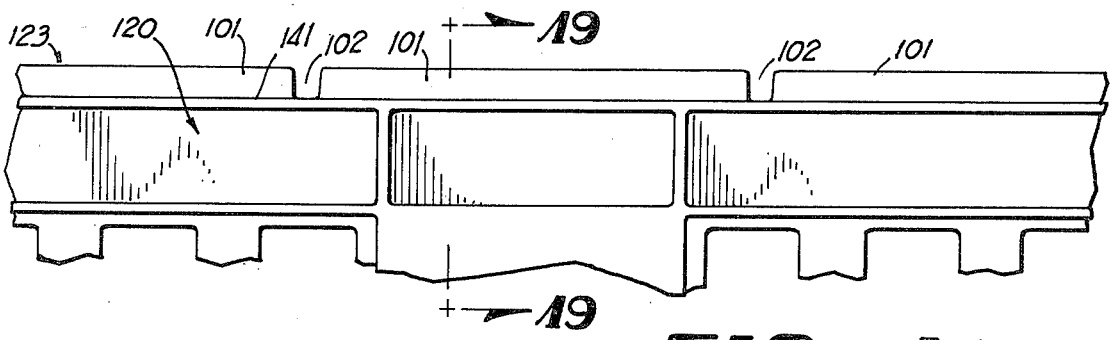
FIG. 14 is a fragmentary side elevational view of the top edge portion of the second embodiment of a container constructed in accordance with the present invention.

When it is desired to collapse the container of the present invention, the bottom panels 25 and 26 are folded upwardly so that they pivot about the pivot pins 50*a* and move from their horizontal positions to their vertical positions abutting the inner surfaces of the side walls 30 of the wall members 20 and 21, as illustrated in FIG. 12. Thereafter, the end wall members 21 and 24 are pivoted to positions to be coplanar with their associated side walls 30 of the wall members 20 and 21, as illustrated in FIG. 13. In such a position, it will be seen that the bottom panels 25 and 26 are sandwiched between the coplanar side wall 30 of wall member 20 and the end wall member 23 on one side and the side wall of side wall member 24 and the end wall member 21 on the other side. It will also be observed that the fingers 70*a* and 70*b* protrude beyond the outer surfaces of end wall members 23 and 24 so as to be received in the holes 52*a* and 52*c* (seen in FIG. 1) when the collapsed containers are set, one on top of the other, and received in the holes 52*b* when the collapsed containers are staggered in the stacking.

It will also be observed that when the containers are righted as shown in FIG. 11, they are capable of being both nested one on top of the other as hereinabove explained or they may be crosstied. When the containers are crosstied, two containers will form a square and hence the containers may be disposed in one layer of two at right angles to the next layer. Such an arrangement is illustrated in FIG. 1 by the broken lines which illustrate two containers. The width of the notch or recess 48 is approximately equal to the thickness of two side members 20 and 21, as illustrated.

Referring specifically to the second embodiment of the present invention as depicted in FIGS. 14 through 20, when a flexible plastic material is employed for producing the container of the present invention, such as when the container is produced of a high density polyethylene, it is preferable to provide the nesting lugs which are depicted in FIGS. 14 through 20 as extending from the upper and lower flanges of the container. As will be explained hereinafter, the camming surfaces of these lugs cooperate to cause the walls of the container to be pulled into alignment with the walls of the next adjacent upper container.

In more detail, the container of FIGS. 14–20 include a side wall member 120 which is identical to side wall member 20, except for the lugs 101 which extend up from the upper flanges 141 and the lugs 195, 196*a* and 196*b* which protrude from lower flanges 143. Furthermore, the end wall members, such as member 123, is identical to the end wall members 23 and 24, except for the lugs 201 which protrude the upper flange 81 and the lugs 295, 296 and the corner guides 297 which protrude from lower flange 82.

In more detail, integrally secured to and protruding upwardly from the upper flange 141 of the side wall member 120 are a plurality of upstanding, longitudinally aligned, alignment lugs 101, the ends of which are spaced from each other to provide upwardly opening spaces 102, therebetween. Similar lugs 201 having spaces 202 are arranged along flange 181. These lugs 101 and 201 are arranged at spaced location throughout the perimeter of the upper edge portion of the container of FIGS. 14–20. Each of lugs 101 and 201 is identical. Thus, lug 101 has an inner vertical edge 103 which is in a common plane with a vertical inner surface 104 of its associated wall member, such as side wall member 120 or end wall member 123. The outer surface of the lug 101, as best seen in FIG. 18, is beveled, having an inwardly facing, straight inwardly and downwardly inclined camming surface 105 which is over the outer portion of the upper surface of the flange 141. Thus, the surfaces 103 and 105 taper upwardly to a narrow upper edge 106.

It is now seen that the camming surfaces 105 of the walls, such as wall 120, converge downwardly at about a 45° angle to the horizontal.

At the bottom edge, there are alignment outer lugs 195 which are spaced from each other along the bottom surface of the bottom flange 143 of the side wall members, such as member 120. Each lug 195 is integrally formed with its flange 143 and protrudes downwardly therefrom, the lug 195 being spaced from the next adjacent lug 195 but is in longitudinal alignment therewith. There is, however, a very substantial central spacing between the downwardly protruding lugs 195 toward the center portion of the side 120. This facilitates the receipt of cross-tied containers, denoted generally by the numeral 119 in FIG. 15.

Figure 15:
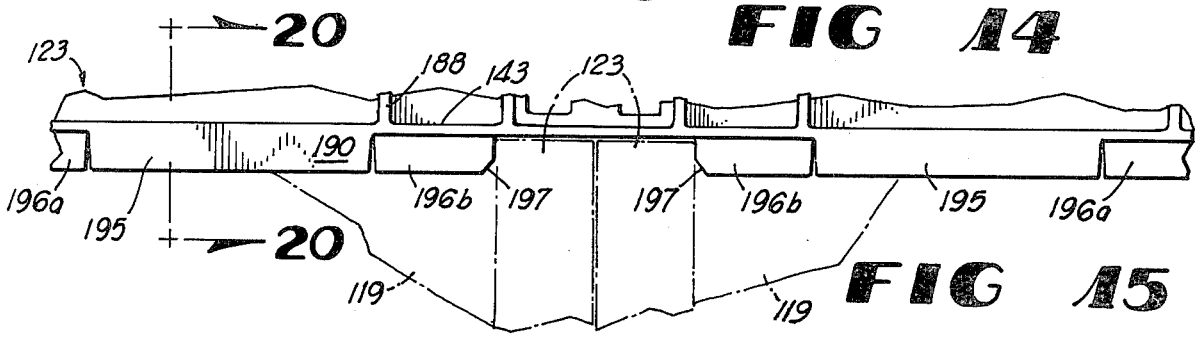
FIG. 15 is a fragmentary side elevational view of the bottom edge portion of the side depicted in FIG. 14.
Figure 16:
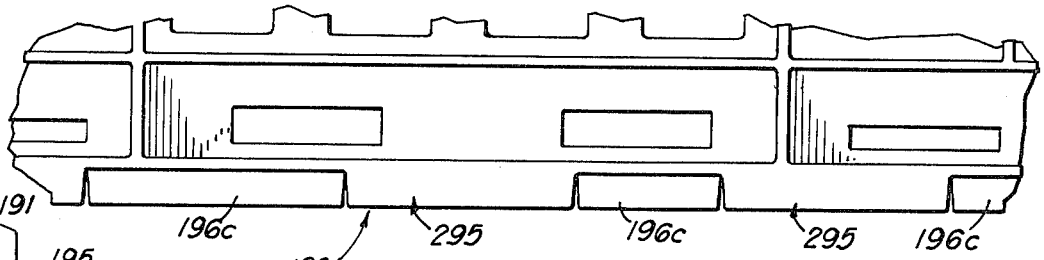
FIG. 16 is a fragmentary end elevational view of the bottom edge of one end of the container depicted in FIGS. 14 and 15.

Staggered with respect to the lugs 195 are the aligned flat inner lugs **196*a* and 196*b*, the central lugs 196*b* of which are spaced apart sufficiently to receive the end walls 123 of a pair of end to end cross-tied containers 19 such as illustrated in FIG. 15. These lugs 196*b* have upwardly tapered inner corners 197 to center end wall 123**.

Each outer bottom lug 195 has a vertical outer surface 190 which is aligned with the outer surface of the ribs and flanges, such as ribs 188 and flange 143. Each lug 195 also includes a beveled inwardly and downwardly facing camming surface 191 and a bottom surface 192. The beveled surface is at a 45° angle and forms a camming surface which cooperates with the beveled or camming surface 105 of another container, whereby when the containers are righted and stacked, the beveled surface 191 will be received over the beveled surface 104 of the container therebelow and cooperate therewith so as to urge the lower container's sides or wall members inwardly.

The bottom edges 192 are in a common plane with each other and with the bottom edges of the guides or lugs 196 so as to provide feet on which the container rests when the container is on a flat surface. The inner lugs **196*a* and 196*b* are spaced inwardly of the lugs 195 and function to arrest inward movement of the upper lugs 101 of the lower container. Thus, the upper lugs 104, being relatively long with respect to the lugs 195 and 196, are confined therebetween when the containers are stacked. Hence, the containers whether stacked one on top of the other or whether cross-tied will be locked in position with respect to the next container above or below. The locking ability of the lugs 101, 195, 196*a* and 196*b*** are sufficient that a stack of such containers can be tilted to a 30° angle without the stack toppling over. Therefore, there is little need for straps or other retaining devices when the container are stacked even in a vertical aligned row without cross-tying. The cross-tying, of course, improves the integrity of the stack so as to enable tilting to a very substantial extent without the stack coming apart.

When stacked on a pallet for transportation, such stacks are quite readily transportable with lift forks. Also, they may be loaded in stacks onto trucks and the normal vibration of a truck will not cause the stack to deteriorate. The flexibility of the major components, namely the side members, end members and bottom members facilitate the assembly and disassembly of the container and also facilitate the bending of the container so as to align the dove-tailed bottom portions for inner-locking. Another advantage of having the flexible major components is that they will flex to lie flat when stacked in a collapsed condition.

Figure 17:
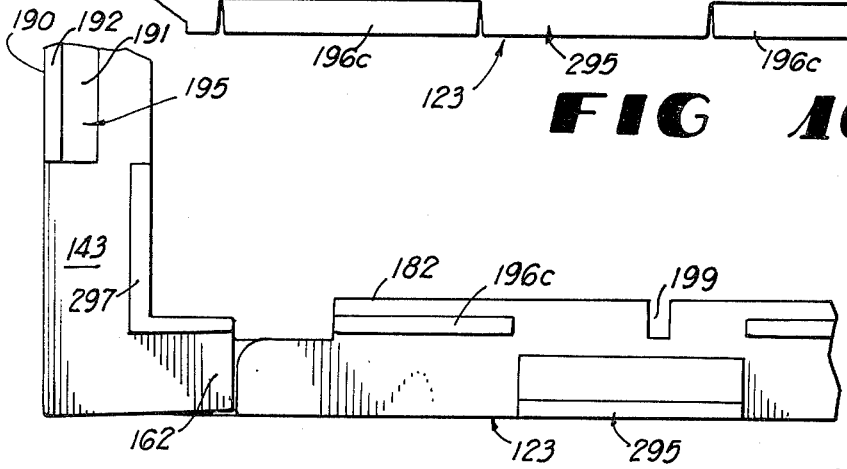
FIG. 17 is a fragmentary bottom plan view of one corner portion of the container depicted in FIGS. 14, 15 and 16.
Figure 18:
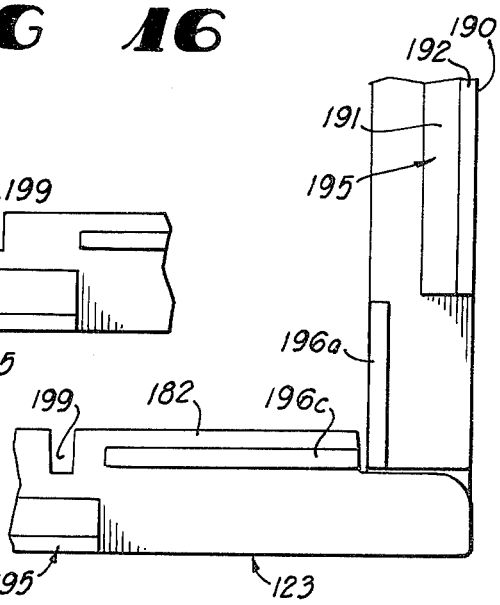
FIG. 18 is a view similar to FIG. 17 but showing the other bottom corner of the container.
Figure 19:
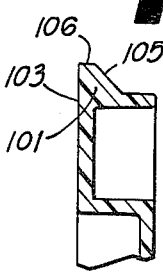
FIG. 19 is a cross-sectional view taken substantially along lines 19—19 in FIG. 14.
Figure 20:
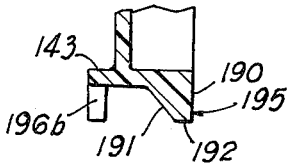
FIG. 20 is a cross-sectional view taken substantially alone lines 20—20 in FIG. 15.

It will be observed in FIGS. 17 and 18 that the bottom flange 182 is notched rearwardly of each lug 195 so as to provide inwardly opening longitudinally spaced notches 199 which open inwardly. The purposes of these notches 199 is to reduce the tendency of the side wall member 120 or the end wall member 123 to bow inwardly. Such tendency is because the high density polyethylene cools unevenly with the thicker parts cooling more slowly. It will also be understood that the openings or notches 102 reduce the bowing effect on flange 143.

At the corner formed by wall member 120 and its hinge member 131 and along the abutment of their lower flanges 143 and 162 is a downwardly protruding L-shaped corner stop or guide 297 one leg of which are aligned with the inner lugs **196*a* and 196*b* and the other leg of which is aligned with the inner lugs 196*c* on end wall 123. The outer surfaces of inner lugs 196*a*, 196*b*, 196*c* and corner stops 297** receive the inner perimeter of the upper edge of a container when the containers are stacked.

I claim:

1. A collapsible container comprising: side wall members, each including a rectangular side wall and a corner portion, said corner portion projecting inwardly from one end of said side wall;

(a) an opposed generally parallel pair of side wall members, each including a rectangular side wall and a corner portion, said corner portion projecting inwardly from one end of said side wall;

(b) a pair of opposed generally parallel rectangular additional wall member;

(c) first pivot means pivotally connecting side edge portions of said additional wall members respectively with the corner portions of said side wall members, and the other side edge portions of the said additional wall members respectively with the other ends of said side walls;

(d) said first pivot means defining parallel vertically extending axes, the pivot axis between said corner portion of each side wall member and an additional wall member being spaced inwardly of the inner surface of the side wall of that side wall member;

(e) a generally flat bottom panel;

(f) journal means on the lower edge portions of said one of the aforesaid wall members;

(g) second pivot means being loosely journalled by said journal means and being moveable vertically in said journal means, said second pivot means protruding into said journal means and loosely pivotally connecting one edge portion of said bottom panel with said journal means; and (h) support means on said wall members and so disposed that said support means supports said bottom panel by its edge portions and without appreciable support from said journal means when said panel is across the open bottom of the container, said bottom panel pivoting from its position across the open bottom of the container to a position adjacent said one of said wall members, said wall members pivoting toward each other to a flattened condition for sandwiching said bottom panel therebetween, when said bottom panel is adjacent to the associated wall member;

(i) said journal means having a first portion thereof inwardly of portions of said pivot means for arresting inward movement of said pivot means for thereby normally preventing said pivot means from being removed from said journal means, said journal means also having vertically spaced portions for confining movement of said pivot means in a vertical direction, said spaced portions being spaced apart sufficiently that, when said bottom panel is disposed across said open bottom, substantially all of the weight downwardly on said bottom panel is transmitted by said bottom panel to said support means and said pivot means is essentially free of said vertically spaced portions.

2. The collapsible container defined in claim 1 including a second bottom panel loosely connected to the lower portion of another of the aforesaid wall members, the first mentioned bottom panel and the second bottom panel when the container is righted, pivoting from an upper position downwardly toward each other so that the bottom panels are in a common plane and wherein the outer edges of the aforesaid bottom panels are in abutting relationship, said support also supporting said second bottom panel.

3. The collapsible container defined in claim 2 wherein the abutting outer edges of said panels include spaced lugs which dovetail together when the panels are disposed in a common plane, the dovetailed portions of said bottom panels being wider at their extremities to prevent appreciable movement of the bottom panels away from each other.

4. The collapsible container defined in claim 1 wherein said first pivot means include a plurality of pivot axes disposed in parallel vertical relationship, elements forming said first pivot means being integral with said wall members.

5. The collapsible container defined in claim 1 wherein said support means includes ledges protruding inwardly from said said members for supporting said bottom panel when the container is righted, said ledges receiving a plurality of edge portions of said bottom panel.

6. The collapsible container defined in claim 5 including cam members at the inner corners formed by said ledge and its wall members for camming said bottom panel and said side wall members together.

7. The collapsible container defined in claim 5 wherein said bottom panel is provided with openings along their edge portions and said ledges include upstanding lugs for being received in said openings.

8. The collapsible container defined in claim 1 wherein said one of the aforesaid wall members is provided with openings along its lower portion, said second pivot means includes pairs of laterally flexible pivot arms connected to an edge of said bottom panel, said pivot arms projecting upwardly and outwardly through said openings in the lower edge portion of said one of the aforesaid wall members, and pivot pins carried by the ends of said pivot arms, said pivot pins extending laterally in opposite directions from each other and transversely of said arms, said pivot pins being disposed on the outer side of said one of the aforesaid wall members, portions of said one of the aforesaid wall members being coplanar with said first portion of said journal means for arresting inward movement of said pins through said opening except when said arms are flexed toward each other.

9. The collapsible container defined in claim 1 wherein the side wall of said collapsible container when said container is righted is approximately twice the length of said additional wall members of said collapsible container.

10. The collapsible container defined in claim 1 wherein said side wall includes an inner panel and a plurality of crisscrossed ribs protruding outwardly from said inner panel.

11. The collapsible container defined in claim 1 wherein said first pivot means includes a plurality of pivot arms secured to said one of the aforesaid wall members and extending toward the other of the wall members and including pivot pins protruding in opposite directions from the outer end portions of said arms transversely of said arms, the other of said wall members including spaced aligned sockets for respectively receiving said pivot pins, said pivot pins being aligned vertically, said arms being flexible for permitting movement of said pivot pins toward each other when said pivot pins are installed in said sockets and removed therefrom.

12. The collapsible container defined in claim 11 including an additional pivot pin journalled by one of the wall members and carried by the other of the wall members, said pivot pin being aligned with the aforesaid pivot pins, the additional pivot pin being removable.

13. The collapsible container defined in claim 11 including fingers which protrude between pairs of said arms when said container is righted for preventing inadvertent removal of the pivot pins carried by said arms from their respective sockets.

14. A collapsible container comprising:

(a) an opposed generally parallel pair of side wall members, each including a rectangular side wall and a corner portion, said corner portion projecting inwardly from one end of said side wall;

(b) a pair of opposed generally parallel rectangular additional wall members;

(c) first pivot means pivotally connecting side edge portions of said additional wall members respectively with the corner portions of said side wall members, and the other side edge portions of the said additional wall members respectively with the other ends of said side walls;

(d) said pivot means defining parallel vertically extending pivot axes, the pivot axis between said corner portion of each side wall member and an additional wall member being spaced inwardly of the inner surface of the side wall of that side wall member;

(e) a generally flat bottom panel;

(f) second pivot means pivotally connecting one edge portion of one of aforesaid wall members, said panel pivoting from a horizontal position into the open bottom portion of the container to a position adjacent said one of said wall members, said wall members pivoting toward each other to a flattened condition for sandwiching said bottom panel therebetween, when said bottom panel is adjacent to its associated wall member; and (g) said first pivot means including a plurality of fingers which protrude from one of the wall members adjacent the pivot means thereof and which is within the confines of the wall members when the container is in its righted position and projects from the surface of the plane of a wall member when the container is in a collapsed condition, one of said wall members having an opening so that when a plurality of said containers are stacked in a collapsed condition, one on top of the other, the fingers of one container will project into the opening of another container.

15. The collapsible container defined in claim 14 wherein said fingers include a pair of spaced fingers and wherein the openings include at least three openings spaced apart by a distance equal to the distance between said fingers so that said fingers may be selectively insertable in any two of the three openings.

16. An upwardly open container of the type having flexible side and end wall members defining upper and lower perimetrical edges and a bottom therein spaced upwardly from the lower perimetrical edges, the improvement comprising:

outwardly protruding camming lugs having camming surfaces for protruding respectively upwardly and downwardly from the upper and lower perimetrical edges of said wall members, said camming surfaces of said lugs along said lower edges facing downwardly and inwardly, said camming surfaces of said lugs along the upper edges facing upwardly and outwardly and being sufficiently aligned vertically with the camming surfaces of said lugs of said lower edges so as to cooperate with the camming surfaces of the lugs along the lower edges of a similar container, said wall members being sufficiently flexible that when the camming surfaces of the lugs of said upper edges engage and the camming surfaces of the lugs of the lower edges of another substantially identical container, such camming surfaces of the engaging lugs will flex said wall members and urge them inwardly are generally into alignment with the corresponding walls of said substantially identical container and arresting means for arresting the inward movement of said wall members when substantial alignment with the wall members of said substantially identical container has been achieved.

17. The container defined in claim 16 wherein said arresting means including inner lugs on the lower perimetrical edges of said wall members.

18. The container defined in claim 16 including corner guides protruding downwardly from diagonally opposed corners of said lower edges of said wall members for guiding the container into the upper portion of a substantially identical container.

19. The containers defined in claim 18 wherein said corner guides are L-shaped members, the surfaces of which are inwardly of the camming surfaces of the lugs of said lower edges.

20. The container defined in claim 16 wherein said arresting means are flat, generally rectangular lugs which are in alignment with each other along the inner portions of said wall members, said inner lugs being spaced inwardly of said camming lugs.

21. The container defined in claim 20 wherein said camming lugs are spaced from each other and said inner lugs are spaced from each other, said camming lugs and said inner lugs being staggered with respect to each other.

22. The container defined in claim 16 wherein said cammings lugs are in alignment along the edges of said wall members, the lower ends of the camming lugs along the bottom edge of said container being outwardly of the upper edges of the camming lugs along the upper edge of said container.

23. A collapsible container comprising:

(a) an opposed generally parallel pair of flexible plastic like wall members, each including a rectangular side wall and a corner portion, said corner portion projecting inwardly from one end of said side wall:

(b) a pair of opposed generally parallel rectangular additional wall members:

(c) first pivot means pivotally connecting side edge portions of said additional wall members respectively with the corner portions of said side wall members, and the other side edge portions of the said additional wall members respectively with the other ends of said side walls;

(d) said pivot means defining parallel vertically extending pivot axes, the pivot axis between said corner portion of each side wall member and an additional wall member being spaced inwardly of the inner surface of the side wall of that side wall member;

(e) a generally flat bottom panel;

(f) second pivot means pivotally connecting one edge portion of said bottom panel to one of aforesaid wall members, said panel pivoting from a horizontal position in the open bottom portion of the container when the container is righted to a position adjacent said one of said wall members, said wall members pivoting toward each other to a flattened condition for sandwiching said bottom panel therebetween, when said bottom panel is adjacent to its associated wall member; and (g) at least one opposed pair of side wall members being provided with camming surfaces on their upper and lower edges, one camming surface on one edge being adapted for engaging the other camming surface of a similar container when they are stacked, for flexing the wall members of the lower container inwardly as the camming members come together, and stop means for arresting the inward movement of said side wall members.

24. The collapsible container defined in claim 23 including means on said bottom panel for locking said bottom against appreciable outward movement when said bottom panel is in a horizontal position.

25. The collapsible container defined in claim 24 wherein said lower edges are provided with notches which permit cross tying of similar containers.

26. A collapsible container comprising:

(a) an opposed generally parallel pair of side wall members, each including a rectangular side wall and a corner portion, said corner portion projecting inwardly from one end of side wall;

(b) a pair of opposed generally parallel rectangular additional wall members;

(c) first pivot means pivotally connecting side edge portions of said additional wall members respectively with the corner portion of said side wall members, and the other side portions of the said additional wall members respectively with the other ends of said side wall;

(d) said pivot means defining parallel vertically extending pivot axes, the pivot axis between said corner portion of each side wall member and an additional wall member being spaced inwardly of the inner surface of the side wall of that side wall member;

(e) a pair of opposed generally flat bottom panels;

(f) second pivot means pivotally connecting the outer edge portions of said bottom panels with the lower edge portion of an opposed pair of wall members, said panels pivoting from vertical positions downwardly and outwardly to opposed horizontal positions in a common plane across the open bottom of the container said wall members pivoting toward each other to a flattened condition for sandwiching said bottom panels therebetween, when said bottom panels are adjacent to their associated wall members; and (g) cooperative locking elements on the inner edges of said panels for interengagement with each other for preventing appreciable movement outwardly of said panels away from each other;

(h) the opposed pairs of wall members which are connected to said bottom panels being provided at their upper and lower edges with camming surfaces which when said container is stacked with another similar container, cooperates with the camming surfaces of the similar container for urging the side wall members of the lower container inwardly and for thereafter retarding outward movement of such pairs of wall members; and (i) said opposed pair of wall members being provided with downwardly protruding lugs along their lower edges for arresting inward movement of said pairs of wall members beyond alignment with the wall members of the similar container.

* * * * *